US009992842B2

(12) United States Patent
Chiang et al.

(10) Patent No.: US 9,992,842 B2
(45) Date of Patent: Jun. 5, 2018

(54) ILLUMINATION SYSTEM AND METHOD FOR DEVELOPING TARGET VISUAL PERCEPTION OF AN OBJECT

(71) Applicant: Industrial Technology Research Institute, Hsinchu (TW)

(72) Inventors: Ya-Hui Chiang, Hsinchu County (TW); Tzung-Te Chen, Taipei (TW); Chia-Fen Hsieh, Hsinchu County (TW); Shih-Yi Wen, Taipei (TW); Han-Kuei Fu, New Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days. days.

(21) Appl. No.: 15/390,701

(22) Filed: Dec. 26, 2016

(65) Prior Publication Data

US 2017/0111973 A1 Apr. 20, 2017

Related U.S. Application Data

(63) Continuation-in-part of application No. 14/955,057, filed on Dec. 1, 2015, now Pat. No. 9,674,920.
(Continued)

(30) Foreign Application Priority Data

Nov. 20, 2015 (TW) ..... 104138408 A

(51) Int. Cl.
*H05B 33/08* (2006.01)

(52) U.S. Cl.
CPC ..... *H05B 33/0872* (2013.01); *H05B 33/086* (2013.01); *H05B 33/0869* (2013.01)

(58) Field of Classification Search
CPC ..... H05B 33/086; H05B 33/0869; H05B 33/0872; H05B 33/0881; H05B 37/02;
(Continued)

(56) References Cited

U.S. PATENT DOCUMENTS 7,344,279 B2 3/2008 Mueller et al.
7,391,499 B2 6/2008 Schmidt
(Continued)

FOREIGN PATENT DOCUMENTS

CN 102281680 12/2011
CN 102901714 1/2013
(Continued)

OTHER PUBLICATIONS

"Office Action of Taiwan Counterpart Application", dated Aug. 23, 2016, p. 1-p. 7.
(Continued)

*Primary Examiner* — Haissa Philogene
(74) *Attorney, Agent, or Firm* — JCIPRNET

(57) ABSTRACT

An illumination system that includes a light source device and an algorithm unit is provided. The light source includes a color temperature adjustable light source. The algorithm unit is coupled to the light source device and outputs a control signal to the light source device according to a reflection spectrum of an object, a visual color matching function, a visual preference correction function, or a combination of the above. The light source device outputs an illumination beam according to the control signal, so as to develop target visual perception of the object while the object is being irradiated by the illumination beam. A method for developing target visual perception of an object is also provided.

21 Claims, 4 Drawing Sheets

Related U.S. Application Data

(60) Provisional application No. 62/085,657, filed on Dec. 1, 2014.

(58) Field of Classification Search
CPC ..... H05B 37/029; H05B 37/0218; H05B 33/0857; F21K 9/00; F21V 19/001
USPC ..... 362/231, 236, 240, 294, 373, 800, 227; 315/153, 312, 297, 307
See application file for complete search history.

(56) References Cited

U.S. PATENT DOCUMENTS

| | | | | |
|---|---|---|---|---|
| 7,825,996 | B2 | 11/2010 | Yamada et al. | |
| 8,100,552 | B2 * | 1/2012 | Spero | B60Q 1/04 362/227 |
| 8,827,475 | B2 * | 9/2014 | Parker | F21K 9/13 362/293 |
| 8,872,923 | B2 | 10/2014 | Gottwals et al. | |
| 8,976,252 | B2 | 3/2015 | Koh et al. | |
| 9,060,409 | B2 | 6/2015 | Bowers et al. | |
| 9,222,882 | B2 | 12/2015 | Hirabayashi et al. | |
| 9,605,815 | B2 * | 3/2017 | Yamakawa | F21K 9/232 |
| 9,674,920 | B2 * | 6/2017 | Chiang | H05B 33/0872 |
| 2005/0276053 | A1 | 12/2005 | Nortrup et al. | |
| 2010/0097406 | A1 | 4/2010 | Zulch | |
| 2013/0249410 | A1 | 9/2013 | Thompson | |
| 2015/0035440 | A1 | 2/2015 | Spero | |

FOREIGN PATENT DOCUMENTS

| | | |
|---|---|---|
| TW | 200816829 | 4/2008 |
| TW | 201022980 | 6/2010 |
| TW | 201421183 | 6/2014 |
| TW | 201441589 | 11/2014 |
| TW | I476383 | 3/2015 |
| WO | 2014166930 | 10/2014 |

OTHER PUBLICATIONS

"Notice of Allowance of US Prior Application", dated Feb. 7, 2017, p. 1-p. 13.

"Office Action of Taiwan Counterpart Application," dated Oct. 25, 2017, p. 1-p. 7.

* cited by examiner

ILLUMINATION SYSTEM AND METHOD FOR DEVELOPING TARGET VISUAL PERCEPTION OF AN OBJECT

CROSS-REFERENCE TO RELATED APPLICATION

This application is a continuation-in-part application of and claims the priority benefit of a prior application Ser. No. 14/955,057, filed on Dec. 1, 2015, which claims the priority benefits of U.S. provisional application Ser. No. 62/085,657, filed on Dec. 1, 2014, and Taiwan application serial no. 104138408, filed on Nov. 20, 2015. The entirety of each of the above-mentioned patent applications is hereby incorporated by reference herein and made a part of this specification.

TECHNICAL FIELD

The disclosure relates to an illumination system and a method for developing target visual perception of an object.

BACKGROUND

Spectra of different light beams have different hues. Therefore, an object develops different visual perceptions while the object is being irradiated by light sources with different spectra. For instance, while the object is being irradiated by a light beam with a reddish spectrum, the light beam casts a warm hue on the object; while the object is being irradiated by a light beam with a blueish spectrum, the light beam casts a cold hue on the object. In terms of commercial applications, the visual perception developed by the object poses an impact on consumers' desires to shop. The spectrum of the light source, if properly modulated according to design demands, can create experiences which influence consumers' mood as well as stimulate the shopping behavior.

SUMMARY

The disclosure provides an illumination system that allows an object to develop target visual perception while the object is being irradiated by an illumination beam. The disclosure also provides a method for developing target visual perception of an object.

In an exemplary embodiment, an illumination system that includes a light source device and an algorithm unit is provided. The light source includes a color temperature adjustable light source. The algorithm unit is coupled to the light source device and outputs a control signal to the light source device according to a reflection spectrum of an object, a visual color matching function, a visual preference correction function, or a combination thereof The light source device outputs an illumination beam according to the control signal, so as to develop target visual perception of the object while the object is being irradiated by the illumination beam.

In another exemplary embodiment, a method for developing target visual perception of an object includes following steps. A control signal is output by an algorithm unit to a light source device according to a reflection spectrum of the object, a visual color matching function, a visual preference correction function, or a combination thereof, wherein the light source device comprise a color temperature adjustable light source. An illumination beam is output by the light source device according to the control signal, such that the object develops target visual perception while the object is being irradiated by the illumination beam.

Several exemplary embodiments accompanied with figures are described in detail below to further describe the disclosure in details.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DETAILED DESCRIPTION OF DISCLOSED EMBODIMENTS

Figure 1:
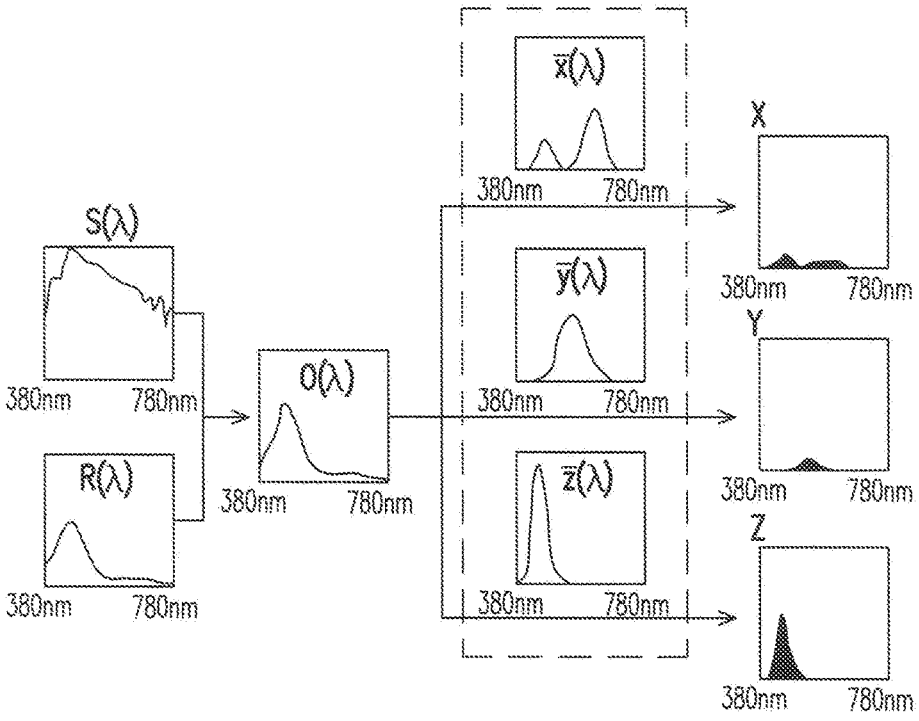
FIG. 1 illustrates an impact of a light source and a visual color matching function on a color of an object visible to human eyes.

FIG. 1 illustrates an impact of a light source and a visual color matching function on a color of an object visible to human eyes. The horizontal coordinate of each block in FIG. 1 represents a wavelength falling within a range from 380 nm to 780 nm. With reference to FIG. 1 and equations (1)-(4), while an object is being irradiated by a light source device, the spectrum $O(\lambda)$ reflected by the object is obtained by multiplying a spectrum $S(\lambda)$ of an emitted light beam from the light source device by a reflection spectrum $R(\lambda)$ of the object and integrating the product of the spectrum $S(\lambda)$ and the reflection spectrum $R(\lambda)$. Human eyes differ in their sensitivities to different wavelengths of light beams, e.g., short wavelengths (420 nm to 440 nm), middle wavelengths (530 nm to 540 nm), and long wavelengths (560 nm to 580 nm); hence, the color (represented by tristimulus values X, Y, and Z) of the object visible to human eyes is the result obtained by multiplying visual color matching functions $\bar{x}(\lambda)$, $\bar{y}(\lambda)$, and $\bar{z}(\lambda)$ (i.e., the blocks surrounded by dotted lines) by the spectrum $O(\lambda)$ reflected by the object while the object is being irradiated by the light source device and integrating the product of the visual color matching functions $\bar{x}(\lambda)$, $\bar{y}(\lambda)$, and $\bar{z}(\lambda)$ and the spectrum $O(\lambda)$. In the equations (2)-(4), k is a constant. The color of the object visible to the human eyes may differ from the true color of the object while the object is being irradiated by the light source device. Besides, human visual perception of different colors may alter due to visual preferences or subjective judgments; for instance, the object in blue may create a cooling effect. In view of the above, the disclosure provides an illumination system and a method for developing target visual perception of an object. The method is applicable to the illumination system, and the illumination beam output by the light source device of the illumination system is modulated according to the aforesaid factors relevant to visual perception, e.g., the reflection spectrum of the object, the visual color matching function, or the visual preferences, such that the object can develop target visual perception while the object is being irradiated by the illumination beam.

$$O(\lambda) = \int_{380}^{780} S(\lambda)R(\lambda)\,d\lambda \tag{1}$$

$$X = k\int_{380}^{780} O(\lambda)\bar{x}(\lambda)\,d\lambda \tag{2}$$

$$Y = k\int_{380}^{780} O(\lambda)\bar{y}(\lambda)\,d\lambda \tag{3}$$

$$Z = k\int_{380}^{780} O(\lambda)\bar{z}(\lambda)\,d\lambda \tag{4}$$

Figure 2:
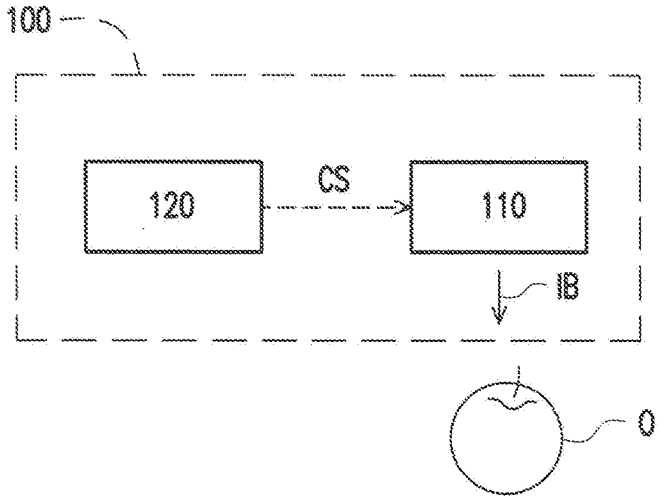
FIG. 2 is a schematic diagram illustrating an illumination system according to an exemplary embodiment of the disclosure.
Figure 3:
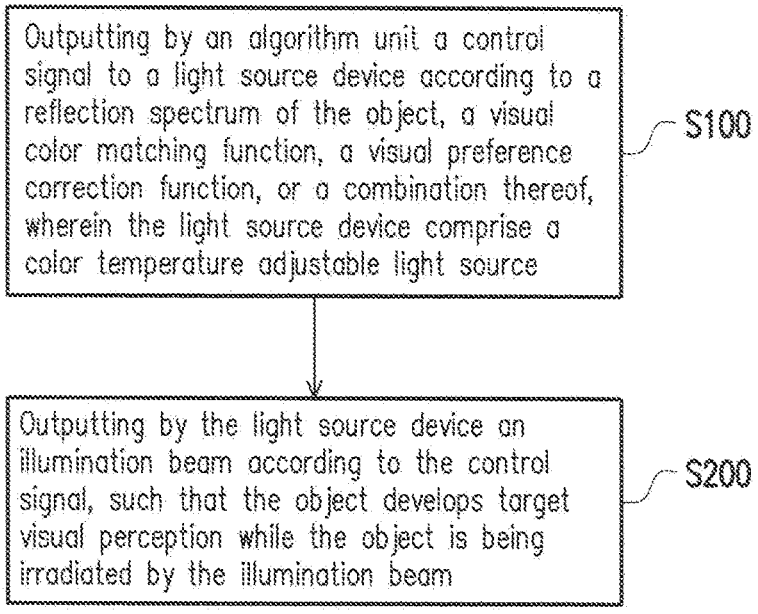
FIG. 3 is a schematic flow chart illustrating a method for developing target visual perception of an object according to an exemplary embodiment of the disclosure.
Figure 4:
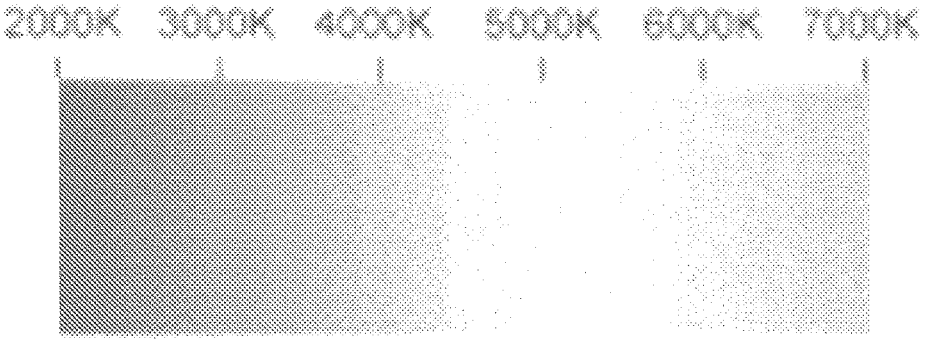
FIG. 4 is a color temperature diagram.
Figure 5:
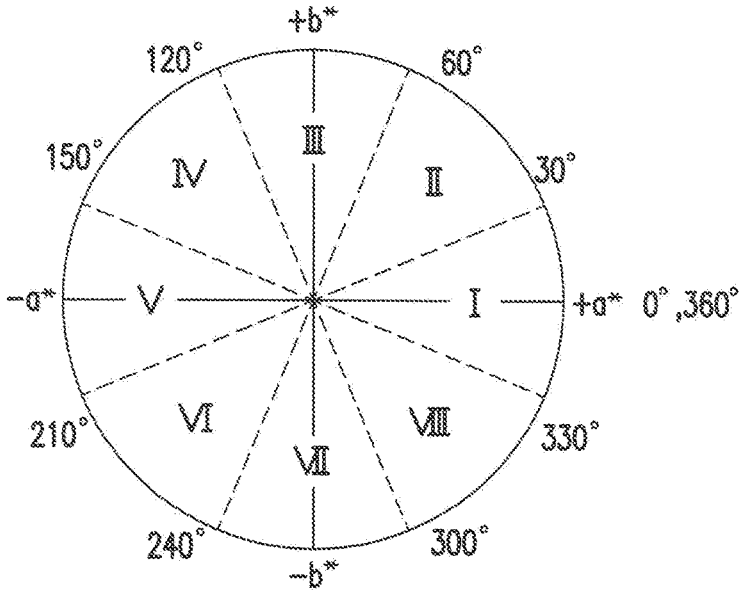
FIG. 5 is a schematic diagram illustrating an a*b* plane of CIE La*b* color space.
Figure 6:
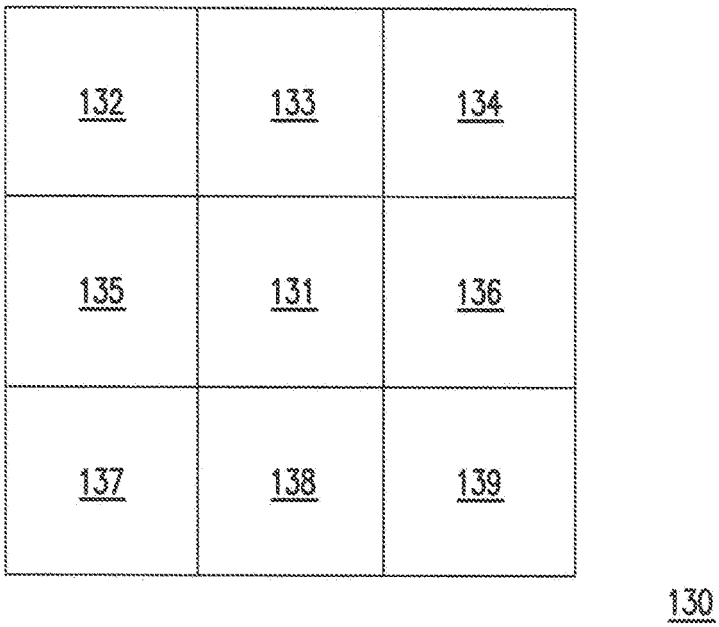
FIG. 6 is a schematic diagram illustrating a color chart of the illumination system in FIG. 2.
Figure 7:
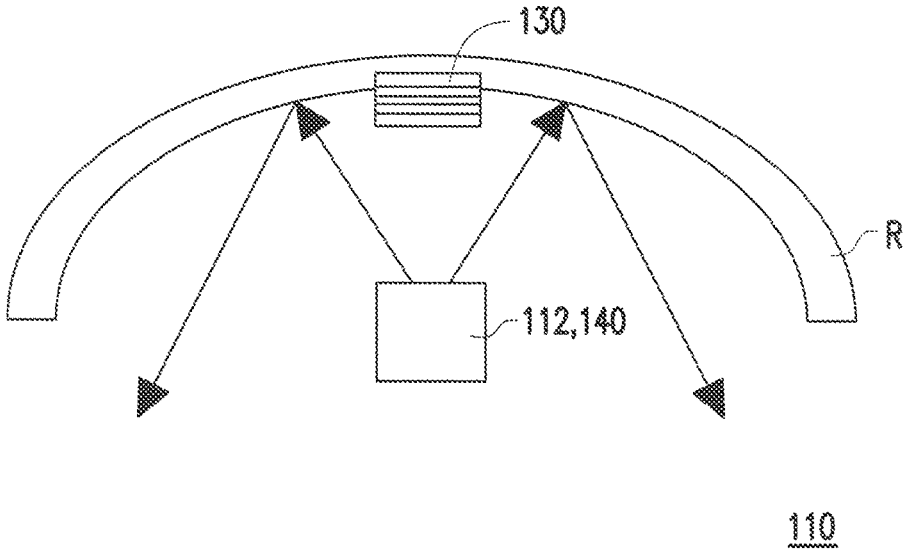
FIG. 7 is a schematic diagram illustrating a light source device of the illumination system in FIG. 2.

FIG. 2 is a schematic diagram illustrating an illumination system according to an exemplary embodiment of the disclosure. FIG. 3 is a schematic flow chart illustrating a method for developing target visual perception of an object according to an exemplary embodiment of the disclosure. FIG. 4 is a color temperature diagram. FIG. 5 is a schematic diagram illustrating an a*b* plane of CIE La*b* color space. FIG. 6 is a schematic diagram illustrating a color chart of the illumination system in FIG. 2. FIG. 7 is a schematic diagram illustrating a light source device of the illumination system in FIG. 2.

With reference to FIG. 2, an illumination system 100 includes a light source device 110 and an algorithm unit 120. The light source device 110 comprises a color temperature adjustable light source (not shown) and is adapted to provide an illumination beam IB to irradiate an object O. For instance, the color temperature adjustable light source may have an adjustable color temperature between 2500K and 6500K and comprises a plurality of light emitting elements (not shown) having different color temperatures. Namely, the light emitting elements have different emission spectra. Specifically, light beams output from the light emitting elements may include at least two different color temperatures, and the intensity of the light beams with any of the color temperatures can be individually modulated. In the embodiment, the light emitting elements may be light emitting diodes (LED), which should however not be construed as a limitation to the disclosure.

The algorithm unit 120 is coupled to the light source device 110 and adapted to output a control signal CS to the light source device 110, such that the light source device 110 modulates intensities of light beams output from the light emitting elements according to the control signal CS. The algorithm unit 120 may transmit the control signal CS to the light source device 110 through a cable or through a wireless connection. In an exemplary embodiment, the algorithm unit 120 may be installed in the light source device 110, a mobile device, a gateway, or a cloud system.

With reference to FIG. 2 and FIG. 3, a method for developing target visual perception of the object O may include following steps. In step S100, the control signal CS is output by the algorithm unit 120 to the light source device 110 according to a reflection spectrum of the object O, a visual color matching function, a visual preference correction function, or a combination thereof, wherein the light source device 110 comprise a color temperature adjustable light source. In step 200, the illumination beam IB is output by the light source device 110 according to the control signal CS, such that the object O develops target visual perception while the object O is being irradiated by the illumination beam IB.

To be specific, the algorithm unit 120 modulates the color temperature (or spectrum) of the illumination beam IB from the light source device 110 according to one, two, or all of the aforesaid factors relevant to visual perception (i.e., the reflection spectrum of the object, the visual color matching function, and the visual preferences). For instance, if it is intended to render the visible color of the object O close to the true color of the object O, the algorithm unit 120 may output the control signal CS according to the reflection spectrum of the object O and the visual color matching function, such that the corrected reflection spectrum is sufficient to compensate the impact of the visual color matching function on visual color perception. In the disclosure, the visual color matching function can be visual color matching functions $\bar{x}(\lambda)$, $\bar{y}(\lambda)$, and $\bar{z}(\lambda)$ corresponding to CIE XYZ color space. Alternatively, the visual color matching function can be visual color matching functions $\bar{r}(\lambda)$, $\bar{g}(\lambda)$, and $\bar{b}(\lambda)$ corresponding to CIE RGB color space. On the other hand, if it is intended to develop a colorful visual perception (i.e., high saturation) or a visual perception associated with visual preferences (e.g. warmth, comfort, coolness, terror, and so on), the algorithm unit 120 may output the control signal CS according to the visual preference correction function, so as to modulate the color temperature (or spectrum) of the illumination beam IB. The visual preference correction function may include a calculation matrix converting the reflection spectrum into a CIE La*b* color space and a calculation matrix adjusting the value (L) while the color coordinate (a*, b*) remains unchanged. For example, by increasing the intensities of light beams with different color temperatures from the light emitting elements, the intensity of the illumination beam IB can be modulated. Alternatively, the visual preference correction function may include a plurality of transformation matrices. Each of the transformation matrices is adapted for modulating the color temperature of the illumination beam IB, so as to correct at least one of a value, a hue, and a chroma of the object O while the object O is being irradiated by the illumination beam IB and develop the target visual perception. Given the same spectrum of light beams and the same color of the object, different people may have different visual perceptions, e.g., the feeling of warmth, comfort, coolness, terror, and so on. Given different colors of the object and different color temperatures of light beams, the transformation matrices may be created by analyzing and calculating visual perceptions of multiple groups of people during experiments, and each of the transformation matrices has independent weighted values corresponding to one of the visual perceptions based on the results of the human factor experiments. The algorithm unit 120 may select at least one target transformation matrix from the transformation matrices according to a visual configuration condition (exemplarily including visual perception and the weighted value). Besides, the algorithm unit 120 outputs the corresponding control signal CS according to the at least one target transformation matrix, so as to modulate the color temperature of the illumination beam IB and thereby modulate at least one of the value, the hue, and the chroma of the object O while the object O is being irradiated by the illumination beam IB and develop the target visual perception.

Since the visual perception is associated with the visual preferences, the illumination beam IB may be modulated according to the characteristics of the object O. Examples are as follows, which should however not be construed as a limitation to the disclosure. In case of the object O is a fresh food material, such as a vegetable or a meat, the color temperature of the illumination beam IB may be higher than 4500K, and a luminous flux of the object O may be larger than 500 lux while the object O is being irradiated by the illumination beam IB. In case of the object O is a cooked food, the color temperature of the illumination beam IB may be lower than 5000K, and a luminous flux of the object O may be larger than 500 lux while the object O is being irradiated by the illumination beam IB. If the object O is a diamond boutique, the color temperature of the illumination beam IB may be higher than 5000K, and a luminous flux of the object O may be larger than 700 lux while the object O is being irradiated by the illumination beam IB. If the object O is a gold boutique, the color temperature of the illumination beam IB may be lower than 5000K, and a luminous flux of the object O may be larger than 700 lux while the object O is being irradiated by the illumination beam IB.

If the visual perception developed by the object O is to be further corrected while the object O is being irradiated by the illumination beam IB, e.g., if at least one of the value, the hue, and the chroma of the object O is to be adjusted or enhanced, the algorithm unit 120 may correct the control signal CS according to the visual preference correction function, so as to further modulate the color temperature (or spectrum) of the illumination beam IB.

To adjust or enhance a specific narrow band of the illumination beam IB, the light source device 110 may further comprise at least one narrow band emitter, and the at least one narrow band emitter is turned on according to the control signal CS. The at least one narrow band emitter may be selected from at least one of narrow band emitters having different emission spectra, such as a first emitter having an emission spectrum ranges from 590 nm to 700 nm, a second emitter having an emission spectrum ranges from 500 nm to 560 nm, a third emitter having an emission spectrum ranges from 430 nm to 500 nm and a forth emitter having an emission spectrum ranges from 550 nm to 600 nm. In the embodiment, the light source device 110 may comprise a plurality of narrow band emitters having different emission spectra, and the narrow band emitters can be individually modulated. For example, the narrow band emitters may comprise the first emitter, the second emitter, the third emitter and the forth emitter listed above. However, the amount of the narrow band emitters included in the light source device 110 and the emission spectrum of each of the narrow band emitters are not limited to the above. In another embodiment, the narrow band emitters may further comprise a fifth emitter having an emission spectrum ranges from 380 nm to 430 nm, for example.

Moreover, at least one of the narrow band emitters may be turned on according to the corrected control signal CS, so as to adjust or enhance a specific narrow band of the illumination beam IB according to the characteristics (e.g. color gamut) of the object O.

When the at least one of the narrow band emitters is turned on according to the corrected control signal CS, an increased amount of the luminous flux of the object O irradiated by the at least one of the narrow band emitters and the color temperature adjustable light source is smaller than 1/2 times of the luminous flux of the object O irradiated by the color temperature adjustable light source. For example, when only one of the narrow band emitters is turned on, an increased amount of the luminous flux of the object O irradiated by the at least one of the narrow band emitters and the color temperature adjustable light source is smaller than 1/3 times of the luminous flux of the object O irradiated by the color temperature adjustable light source. When two of the narrow band emitters is turned on, an increased amount of the luminous flux of the object O irradiated by the at least one of the narrow band emitters and the color temperature adjustable light source is smaller than 1/2 times of the luminous flux of the object O irradiated by the color temperature adjustable light source.

The amount of the narrow band emitter(s) to be turned on may be determined by the color of the object O. Take the a*b* plane of CIE La*b* color space as an example, the a*b* plane of CIE La*b* color space may be divided into eight regions, as shown in FIG. 5. Specifically, the region of an azimuthal angle between 0°-30° and 330°-360° is the region I, the region of an azimuthal angle between 30°-60° is the region II, the region of an azimuthal angle between 60°-120° is the region III, the region of an azimuthal angle between 120°-150° is the region IV, the region of an azimuthal angle between 150°-210° is the region V the region of an azimuthal angle between 210°-240° is the region VI, the region of an azimuthal angle between 240°-300° is the region VII, and the region of an azimuthal angle between 300°-330° is the region VIII. The color coordinate in the region I is corresponding to emission spectrum of the first emitter, the color coordinate in the region V is corresponding to the emission spectrum of the second emitter, the color coordinate in the region VII is corresponding to the emission spectrum of the third emitter, and the color coordinate in the region III is corresponding to the emission spectrum of the forth emitter. In the case that the color coordinate of the object O falls into the region I and the color gamut of the object O exceeds the spectrum of the illumination beam IB, the control signal CS may be corrected to turn on the first emitter, such that the intensity of the emission spectrum of the first emitter corresponding to the region I (i.e. corresponding to the color gamut of the object O) is enhanced. In the case that the color coordinate of the object O falls into the region III and the color gamut of the object O exceeds the spectrum of the illumination beam IB, the control signal CS may be corrected to turn on the forth emitter. In the case that the color coordinate of the object O falls into the region II and the color gamut of the object O exceeds the spectrum of the illumination beam IB, the control signal CS may be corrected to turn on both of the first emitter and the forth emitter. The rest may be deduced by analogy, and therefore not repeated herein.

According to different needs, the illumination system 100 may comprise other elements, and the method for developing target visual perception of the object O may include other steps. For example, prior to the step S100, the algorithm unit 120 may acquire optical parameters (e.g. spectrum, luminous flux, etc.) of the ambient light or the light source device 110, such as the spectrum of an initial illumination beam output from the light source device 110. Several methods of acquiring the spectrum of the light source device 110 are provided below, which should however not be construed as a limitation to the disclosure.

In an embodiment, the illumination system 100 may further include a spectrometer (not shown) coupled to the algorithm unit 120 to acquire a background spectrum (i.e. the spectrum of the ambient light) or the spectrum of the initial illumination beam output from the light source device 110. Alternatively, the illumination system 100 may further include a color chart (such as the color chart 130 shown in FIG. 6, but not limited thereto) and an image acquiring device (not shown) coupled to the algorithm unit 120.

As shown in FIG. 6, the color chart 130 may be a combination color chart comprising a reference white chart 131 and a plurality of narrow band color charts (e.g. eight narrow band color charts marked as 132, 133, 134, 135, 136, 137, 138 and 139 respectively) having different reflection spectra between 380 nm and 780 nm, and a full width at half maximum (FWHM) value of each of the narrow band color charts is between 20 nm and 100 nm. For example, reflection spectra of the narrow band color charts 132, 133, 134, 135, 136, 137, 138 and 139 respectively range from 380 nm to 430 nm, from 430 nm to 480 nm, from 480 rim to 530 nm, from 530 nm to 580 nm, from 580 nm to 630 nm, from 630 nm to 680 nm, from 680 nm to 730 nm and from 730 nm to 780 nm. In another embodiment, the narrow band color charts may have different reflection spectra between 400 nm and 700 nm, and reflection spectrum of each of the narrow band color charts may be divided with the same proportion between 400 nm and 700 nm. Alternatively, the color chart may be other color chart in the art.

The image acquiring device can be any device suitable for acquiring the color information of the object O, such as a charge coupled device (CCD) or a complementary metal oxide semiconductor (CMOS); however, the disclosure is not limited thereto. In an embodiment, the color chart 130 and the image acquiring device may be integrated into the light source device 110. As shown in FIG. 7, the light source device 110 may include a reflector R, the color chart 130 may be adhered to an inner surface of the reflector R, while the light emitting elements 112 and the image acquiring device 140 are disposed under the reflector R, which should however not be construed as a limitation to the disclosure. By integrating the color chart 130 and the image acquiring device 140 into the light source device 110, the optical parameters of the initial illumination beam may be acquired directly. However, the relative position relationship is not limited to that shown in FIG. 7.

Under the presence of ambient light, the method for acquiring the optical parameters of the background spectrum and the initial illumination beam may include following steps. The light source device 110 is turned off and a spectrum reflected by the color chart 130 is acquired by the image acquiring device 140 while the color chart 130 is being irradiated by the background spectrum. Optical parameters (e.g. color coordinates, CRI, luminous flux, etc.) of the background spectrum are acquired by the algorithm unit 120 according to reflection spectra of different regions (different narrow band color charts) of the color chart 130 and the spectrum reflected by the color chart 130 while the color chart 130 is being irradiated by the background spectrum. A spectrum reflected by the color chart 130 is acquired by the image acquiring device 140 while the color chart 130 is being irradiated by the background spectrum and the initial illumination beam output from the light source device 110. Optical parameters (e.g. color coordinates, CRI, luminous flux, etc.) of the initial illumination beam are acquired by the algorithm unit 120 according to the optical parameters of the background spectrum, the reflection spectra of different regions of the color chart and the spectrum reflected by the color chart 130 while the color chart 130 is being irradiated by the background spectrum and the initial illumination beam. Specifically, the algorithm unit 120 may acquire the optical parameters of the initial illumination beam by comparing the reflection spectra of different regions of the color chart with the spectrum reflected by the color chart 130 while the color chart 130 is being irradiated by the background spectrum and the initial illumination beam and by normalizing the optical parameters of the background spectrum.

On the other hand, without the presence of ambient light, the method for acquiring optical parameters of the initial illumination beam may include following steps. A spectrum reflected by the color chart 130 is acquired by the image acquiring device 140 while the color chart 130 is being irradiated by the initial illumination beam output from the light source device 110. Then, the optical parameters of the initial illumination beam is acquired by the algorithm unit 120 according to reflection spectra of different regions of the color chart 130 and the spectrum reflected by the color chart 130 while the color chart 130 is being irradiated by the initial illumination beam.

Prior to the steps of acquiring optical parameters of the ambient light or the light source device 110, the algorithm unit 120 may perform a color correction on the image acquiring device 140. Several methods of performing the color correction on the image acquiring device are provided below, which should however not be construed as a limitation to the disclosure.

Under the presence of ambient light, a spectrometer (not shown) coupled to the algorithm unit 120 may be configured to acquire optical parameters of an overall spectrum including the background spectrum and the spectrum of the initial illumination beam output from the light source device 110. Then, a spectrum reflected by the color chart (e.g. the color chart in FIG. 6 or other color chart in the art) is acquired by the image acquiring device 140 while the color chart is being irradiated by the background spectrum and the initial illumination beam. Afterwards, the color correction is performed on the image acquiring device 140 by the algorithm unit 120 according to the optical parameters of the overall spectrum, reflection spectra of different regions of the color chart and the spectrum reflected by the color chart while the color chart is being irradiated by the background spectrum and the initial illumination beam.

On the other hand, without the presence of ambient light, the spectrum reflected by the color chart (e.g. the color chart in FIG. 6 or other color chart in the art) is acquired by the image acquiring device 140 while the color chart is being irradiated by the initial illumination beam output from the light source device 110. Then, the color correction is performed on the image acquiring device 140 by the algorithm unit 120 according to reflection spectra of different regions of the color chart, optical parameters of the initial illumination beam and the spectrum reflected by the color chart while the color chart is being irradiated by the initial illumination beam.

Several methods for developing target visual perception of the object O are provided below, which should however not be construed as a limitation to the disclosure. Without the presence of ambient light, the spectrum reflected by the object O is acquired by a color-corrected image acquiring device while the object O is being irradiated by the initial illumination beam having known optical parameters and output from the light source device 110. Then, by comparing the optical parameters of the object O with the optical parameters of the initial illumination beam, a preference spectrum is calculated by the algorithm unit 120. Afterwards, the control signal CS is output by the algorithm unit 120 to the light source device 110, and the illumination beam IB is output by the light source device 110 according to the control signal CS, such that the object O develops target visual perception while the object O is being irradiated by the illumination beam IB. In the case that the image acquiring device is not color corrected before acquiring the spectrum reflected by the object O, the spectrum reflected by the color chart (e.g. the color chart in FIG. 6 or other color chart in the art) may be acquired by the color uncorrected image acquiring device while the color chart is being irradiated by the initial illumination beam having known optical parameters, so that the algorithm unit 120 may perform color correction on the color uncorrected image acquiring device before the image acquiring device acquire the spectrum reflected by the object O.

On the other hand, under the presence of ambient light, a spectrometer (not shown) may be optionally configured to acquire optical parameters of the background spectrum and an overall spectrum including the background spectrum and the spectrum of the initial illumination beam output from the light source device 110. The spectrum reflected by the object O is acquired by the color-corrected image acquiring device while the object O is being irradiated by the background spectrum and the initial illumination beam having known optical parameters and output from the light source device 110. Then, optical parameters of the object O are acquired by the algorithm unit 120 according to the optical parameters of the background spectrum, the optical parameters of the initial illumination beam, the spectrum reflected by the object O while the object O is being irradiated by the background spectrum and the initial illumination beam. By comparing the optical parameters of the object O with the optical parameters of the initial illumination beam, a preference spectrum is calculated by the algorithm unit 120. Afterwards, the control signal CS is output by the algorithm unit 120 to the light source device 110, and the illumination beam IB is output by the light source device 110 according to the control signal CS, such that the object O develops target visual perception while the object O is being irradiated by the illumination beam IB. In the case that the image acquiring device is not color corrected before acquiring the spectrum reflected by the object O, the spectrum reflected by the color chart (e.g. the color chart in FIG. 6 or other color chart in the art) may be acquired by the color uncorrected image acquiring device while the color chart is being irradiated by the background spectrum and the initial illumination beam having known optical parameters, so that the algorithm unit 120 may perform color correction on the color uncorrected image acquiring device before the image acquiring device acquire the spectrum reflected by the object O. In the case that the optical parameters of the light source device 110 is unknown, the optical parameters of the initial illumination beam may be acquired in advance (with reference to paragraph [0030]), and steps illustrated above are then executed.

In practical applications, the illumination system 100 may further include a user interface coupled to the algorithm unit 120. The user interface may display a color temperature block diagram (referring to FIG. 4) or a color gamut diagram (such as the a*b* plane of CIE La*b* color space as shown in FIG. 5). The user may input the information of the object O by an input unit (e.g., a keyboard, a touch panel or a touch display panel) coupled to the algorithm unit 120 or by the image acquiring device. After the information of the object O is processed by the algorithm unit 120, the user interface may indicate the object O on the color temperature block diagram or the color gamut diagram. Then, the control signal CS is output by the algorithm unit 120 to the light source device 110, and the illumination beam IB is output by the light source device 110 according to the control signal CS, such that the object O develops target visual perception while the object O is being irradiated by the illumination beam IB. In an embodiment, the user may modulate the optical parameters (e.g. color, luminous flux, etc.) of the light source device 110 from the user interface.

To sum up, the illumination system and the method for developing target visual perception of the object are provided herein. Here, the illumination beam output by the light source device is modulated according to the reflection spectrum of the object, the visual color matching function, the visual preference correction function, or a combination thereof, such that the object develops target visual perception while the object is being irradiated by the illumination beam. In terms of commercial applications, the illumination effects created by the illumination system are conducive to boosting shopping desires and creating experiences which influence consumers' mood and behavior.

It will be apparent to those skilled in the art that various modifications and variations can be made to the structure of the disclosed exemplary embodiments without departing from the scope or spirit of the disclosure. In view of the foregoing, it is intended that the disclosure cover modifications and variations of this disclosure provided they fall within the scope of the following claims and their equivalents.

What is claimed is:

1. An illumination system, comprising:

a light source device comprising a color temperature adjustable light source; and an algorithm unit coupled to the light source device, the algorithm unit outputting a control signal to the color temperature adjustable light source according to a reflection spectrum of an object, a visual color matching function, a visual preference correction function, or a combination thereof, the light source device outputting an illumination beam according to the control signal, so as to develop target visual perception of the object while the object is being irradiated by the illumination beam.

2. The illumination system as recited in claim 1, wherein the color temperature adjustable light source has an adjustable color temperature between 2500K and 6500K and comprises a plurality of light emitting elements having different color temperatures.

3. The illumination system as recited in claim 1, wherein the light source device further comprises at least one narrow band emitter, and the at least one narrow band emitter is turned on according to the control signal.

4. The illumination system as recited in claim 3, wherein the at least one narrow band emitter is selected from at least one of a first emitter having an emission spectrum ranges from 590 nm to 700 nm, a second emitter having an emission spectrum ranges from 500 nm to 560 nm, a third emitter having an emission spectrum ranges from 430 rim to 500 nm, a forth emitter having an emission spectrum ranges from 550 nm to 600 nm and a fifth emitter having an emission spectrum ranges from 380 nm to 430 nm.

5. The illumination system as recited in claim 1, wherein the light source device further comprises a plurality of narrow band emitters, the narrow band emitters have different emission spectra, and at least one of the narrow band emitters is turned on according to the control signal.

6. The illumination system as recited in claim 1, further comprising:

a spectrometer coupled to the algorithm unit and adapted to acquire a background spectrum or a spectrum of an initial illumination beam output from the light source device.

7. The illumination system as recited in claim 1, further comprising:

a color chart; and an image acquiring device adapted to acquire a spectrum reflected by the color chart while the color chart is being irradiated at least by an initial illumination beam output from the light source device, the algorithm unit being coupled to the image acquiring device.

8. The illumination system as recited in claim 7, wherein the color chart is a combination color chart comprising a reference white chart and a plurality of narrow band color charts having different reflection spectra between 380 nm and 780 nm, and a full width at half maximum value of each of the narrow band color charts is between 20 nm and 100 nm.

9. The illumination system as recited in claim 8, wherein an amount of the narrow band color charts is eight, and reflection spectra of the narrow band color charts respectively range from 380 nm to 430 nm, from 430 nm to 480 nm, from 480 nm to 530 nm, from 530 nm to 580 nm, from 580 nm to 630 nm, from 630 nm to 680 nm, from 680 nm to 730 nm and from 730 nm to 780 nm.

10. The illumination system as recited in claim 8, wherein the narrow band color charts have different reflection spectra between 400 nm and 700 nm.

11. The illumination system as recited in claim 7, wherein the color chart and the image acquiring device are integrated into the light source device.

12. A method for developing target visual perception of an object, comprising:

Outputting, by an algorithm unit, a control signal to a light source device according to a reflection spectrum of the object, a visual color matching function, a visual preference correction function, or a combination thereof, wherein the light source device comprise a color temperature adjustable light source; and Outputting, by the light source device, an illumination beam according to the control signal, such that the object develops target visual perception while the object is being irradiated by the illumination beam.

13. The method as recited in claim 12, wherein the color temperature adjustable light source has an adjustable color temperature between 2500K and 6500K and comprises a plurality of light emitting elements having different color temperatures, and the color temperature adjustable light source modulates intensities of light beams output from the light emitting elements according to the control signal.

14. The method as recited in claim 12, wherein the visual preference correction function indicates the target visual perception, and the algorithm unit outputs the control signal according to the visual preference correction function to modulate a color temperature of the illumination beam, and a luminous flux of the object is larger than 500 lux while the object is being irradiated by the illumination beam.

15. The method as recited in claim 14, wherein the light source device further comprises a plurality of narrow band emitters, the narrow band emitters have different emission spectra, at least one of the narrow band emitters is turned on according to the control signal, wherein an increased amount of the luminous flux of the object irradiated by the at least one of the narrow band emitters and the color temperature adjustable light source is smaller than 1/2 times of the luminous flux of the object irradiated by the color temperature adjustable light source.

16. The method as recited in claim 12, further comprising:

acquiring, by a spectrometer coupled to the algorithm unit, a background spectrum or a spectrum of an initial illumination beam output from the light source device.

17. The method as recited in claim 12, further comprising:

Acquiring, by the algorithm unit, optical parameters of an initial illumination beam output from the light source device and a background spectrum of ambient light with aids of a color chart and an image acquiring device under a presence of ambient light.

18. The method as recited in claim 17, further comprising:

acquiring, by the algorithm unit, optical parameters of the object; and comparing the optical parameters of the object with the optical parameters of the initial illumination beam.

19. The method as recited in claim 12, further comprising:

acquiring, by the algorithm unit, optical parameters of an initial illumination beam output from the light source device with aids of a color chart and an image acquiring device without a presence of ambient light.

20. The method as recited in claim 12, further comprising:

performing, by the algorithm unit, a color correction on an image acquiring device with aids of a color chart and a spectrometer coupled to the algorithm unit under a presence of ambient light.

21. The method as recited in claim 12, further comprising:

performing, by the algorithm unit, a color correction on an image acquiring device with an aid of a color chart without a presence of ambient light.

* * * * *